US009639053B2

(12) United States Patent
Toba et al.

(10) Patent No.: US 9,639,053 B2
(45) Date of Patent: May 2, 2017

(54) IMAGE FORMING APPARATUS AND CARTRIDGE GROUP

(71) Applicant: CANON KABUSHIKI KAISHA, Tokyo (JP)

(72) Inventors: Shinjiro Toba, Yokohama (JP); Toshiki Fujino, Tokyo (JP); Yuichi Fukui, Yokosuka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/050,085

(22) Filed: Feb. 22, 2016

(65) Prior Publication Data

US 2016/0252875 A1 Sep. 1, 2016

(30) Foreign Application Priority Data

Feb. 27, 2015 (JP) ..... 2015-039420
Jan. 21, 2016 (JP) ..... 2016-009780

(51) Int. Cl.

| | |
|---|---|
| ***G03G 21/00*** | (2006.01) |
| ***G03G 21/16*** | (2006.01) |
| ***G03G 15/00*** | (2006.01) |
| ***G03G 15/01*** | (2006.01) |
| ***G03G 21/18*** | (2006.01) |

(52) U.S. Cl.

CPC ..... *G03G 21/1647* (2013.01); *G03G 15/0178* (2013.01); *G03G 15/757* (2013.01); *G03G 21/1807* (2013.01); *G03G 21/1857* (2013.01); *G03G 2215/0119* (2013.01); *G03G 2221/1684* (2013.01)

(58) Field of Classification Search

CPC ..... G03G 15/751; G03G 15/0178; G03G 15/757; G03G 21/1671; G03G 21/1647; G03G 21/1807; G03G 21/1857; G03G 21/1864; G03G 2215/0119; G03G 2221/1657; G03G 2221/1603

USPC ..... 399/167; 347/117, 118

See application file for complete search history.

(56) References Cited

U.S. PATENT DOCUMENTS 8,045,883 B2 * 10/2011 Okabe ..... G03G 15/0178 399/110
2010/0111562 A1 * 5/2010 Okabe ..... G03G 15/757 399/112

FOREIGN PATENT DOCUMENTS

EP 2138908 A1 * 12/2009 ..... G03G 21/1867
JP 2006-3735 A 1/2006
JP 4110128 B2 7/2008
JP 2011-191403 A 9/2011

(Continued)

*Primary Examiner* — Robert Beatty

(74) *Attorney, Agent, or Firm* — Canon USA, Inc. I.P. Division

(57) ABSTRACT

In an image forming apparatus, when a line connecting a midpoint of a line segment connecting a first supporting portion and a second supporting portion and a rotational center of a first photosensitive drum as viewed from a first axial direction of the first photosensitive drum is referred to as a first straight line, and a line connecting a midpoint of a line segment connecting a third supporting portion and a fourth supporting portion and a rotational center of a second photosensitive drum as viewed from a second axial direction of the second photosensitive drum is referred to as a second straight line, the first straight line as viewed from the first axial direction and the second straight line as viewed from the second axial direction are not parallel to each other.

17 Claims, 16 Drawing Sheets

(56) References Cited

FOREIGN PATENT DOCUMENTS

JP 2014056012 A * 3/2014

* cited by examiner

IMAGE FORMING APPARATUS AND CARTRIDGE GROUP

BACKGROUND OF THE INVENTION

Field of the Invention

Aspects of the present invention generally relate to an image forming apparatus and a cartridge group that is detachably attachable to the apparatus body of an image forming apparatus.

In the present specification, the term "image forming apparatus" refers to an apparatus that forms an image on a recording medium. Examples of the image forming apparatus include an electrophotographic copying machine, an electrophotographic printer (for example, a laser beam printer and a light-emitting diode (LED) printer), and a facsimile apparatus, each of which uses, for example, an electrophotographic image forming process.

Furthermore, the term "cartridge" refers to a portion of constituent components of the image forming apparatus that is integrated into a cartridge, which is detachably attachable to the apparatus body of the image forming apparatus. The term "cartridge group" refers to a group of a plurality of cartridges mentioned above.

Moreover, the term "image forming apparatus body (apparatus body)" refers to a portion of the image forming apparatus other than the cartridges.

Description of the Related Art

There is known a conventional structure in which an electrophotographic photosensitive member (a photosensitive drum) is supported by two flat surfaces, as discussed in Japanese Patent No. 4110128.

In the structure discussed in Japanese Patent No. 4110128, a photosensitive member supporting device, which supports a photosensitive drum in such a way as to allow the photosensitive drum to rotate, has two contact surfaces which are not parallel to each other and with which the photosensitive drum is kept in contact to be positioned. Then, the configuration is characterized in that the photosensitive drum is urged in such a way as to be in contact with the two contact surfaces by a process unit, such as a charging roller or developing roller, arranged around the photosensitive drum.

SUMMARY OF THE INVENTION

Aspects of the present invention are generally directed to an improvement in the conventional structure and to stably supporting an image bearing member with a supporting member.

According to an aspect of the present invention, an image forming apparatus includes a first photosensitive drum, a second photosensitive drum, a first drive input portion located at one end in a first axial direction of the first photosensitive drum, a second drive input portion located at one end in a second axial direction of the second photosensitive drum, a first supporting member including a first supporting portion and a second supporting portion that support a side of the one end in the first axial direction of the first photosensitive drum in such a way as to allow the first photosensitive drum to rotate, and a second supporting member including a third supporting portion and a fourth supporting portion that support a side of the one end in the second axial direction of the second photosensitive drum in such a way as to allow the second photosensitive drum to rotate, wherein, when a line connecting a midpoint of a line segment connecting the first supporting portion and the second supporting portion and a rotational center of the first photosensitive drum as viewed from the first axial direction is referred to as a first straight line, and a line connecting a midpoint of a line segment connecting the third supporting portion and the fourth supporting portion and a rotational center of the second photosensitive drum as viewed from the second axial direction is referred to as a second straight line, the first straight line as viewed from the first axial direction and the second straight line as viewed from the second axial direction are not parallel to each other.

Further features of the present invention will become apparent from the following description of exemplary embodiments with reference to the attached drawings.

DESCRIPTION OF THE EMBODIMENTS

[General Description of an Electrophotographic Image Forming Apparatus]

Various exemplary embodiments, features, and aspects of the invention will be described in detail below with reference to the drawings.

In the following exemplary embodiments, a full-color image forming apparatus to the apparatus body of which four process cartridges are detachably attachable is described as an example of an image forming apparatus.

However, the number of process cartridges that are mountable in the image forming apparatus is not limited to four, but may be arbitrarily set as appropriate.

For example, in the case of an image forming apparatus that forms a two-color image, the number of process cartridges that are mountable in the apparatus body of the image forming apparatus is two.

Furthermore, while, in the following exemplary embodiments, a printer is described as an example of the image forming apparatus, a copying machine, a facsimile apparatus, or a multifunction peripheral equipped with a copying function, a facsimile function, and a printer function together may be used.

[General Configuration of an Image Forming Apparatus]

Figure 1:
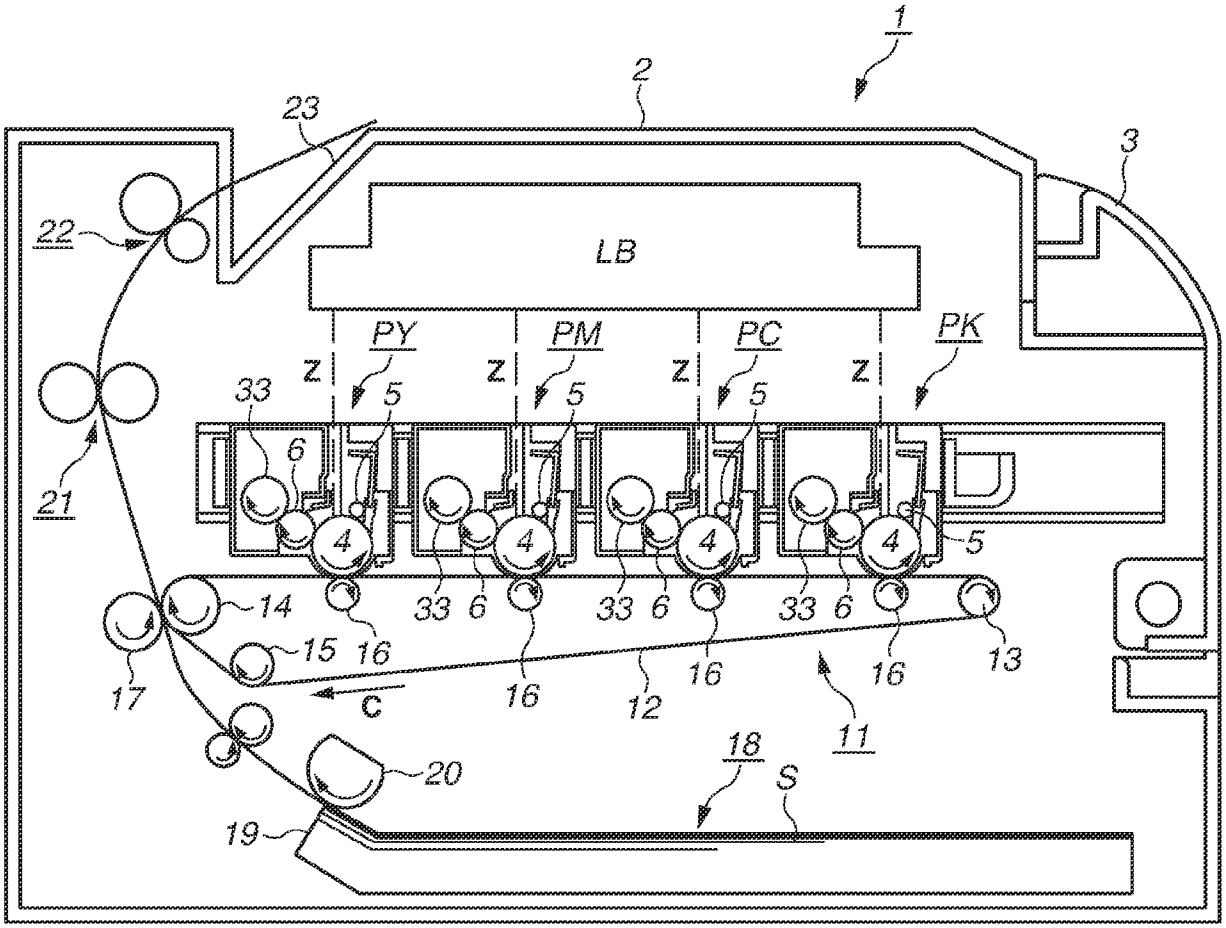
FIG. 1 is a sectional view of an image forming apparatus according to a first exemplary embodiment of the present invention.
Figure 2A:
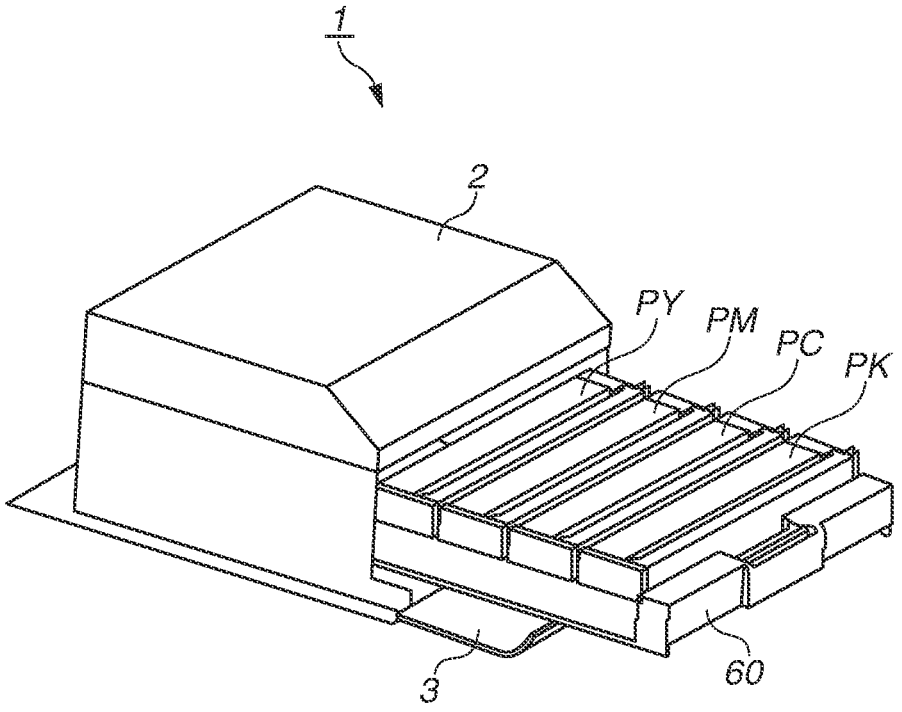
FIGS. 2A and 2B are perspective views of the image forming apparatus according to the first exemplary embodiment.
Figure 5:
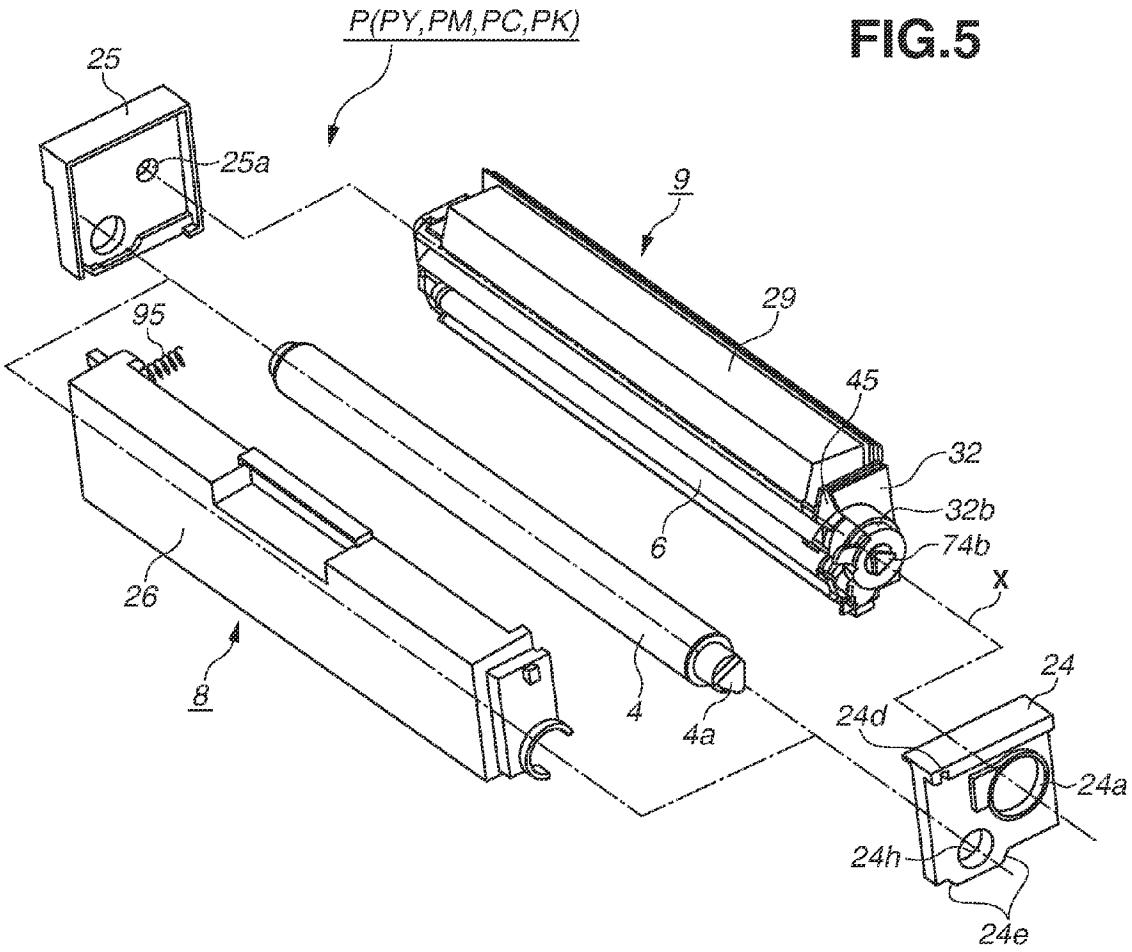
FIG. 5 is an assembling perspective view of a process cartridge according to the first exemplary embodiment.
Figure 6:
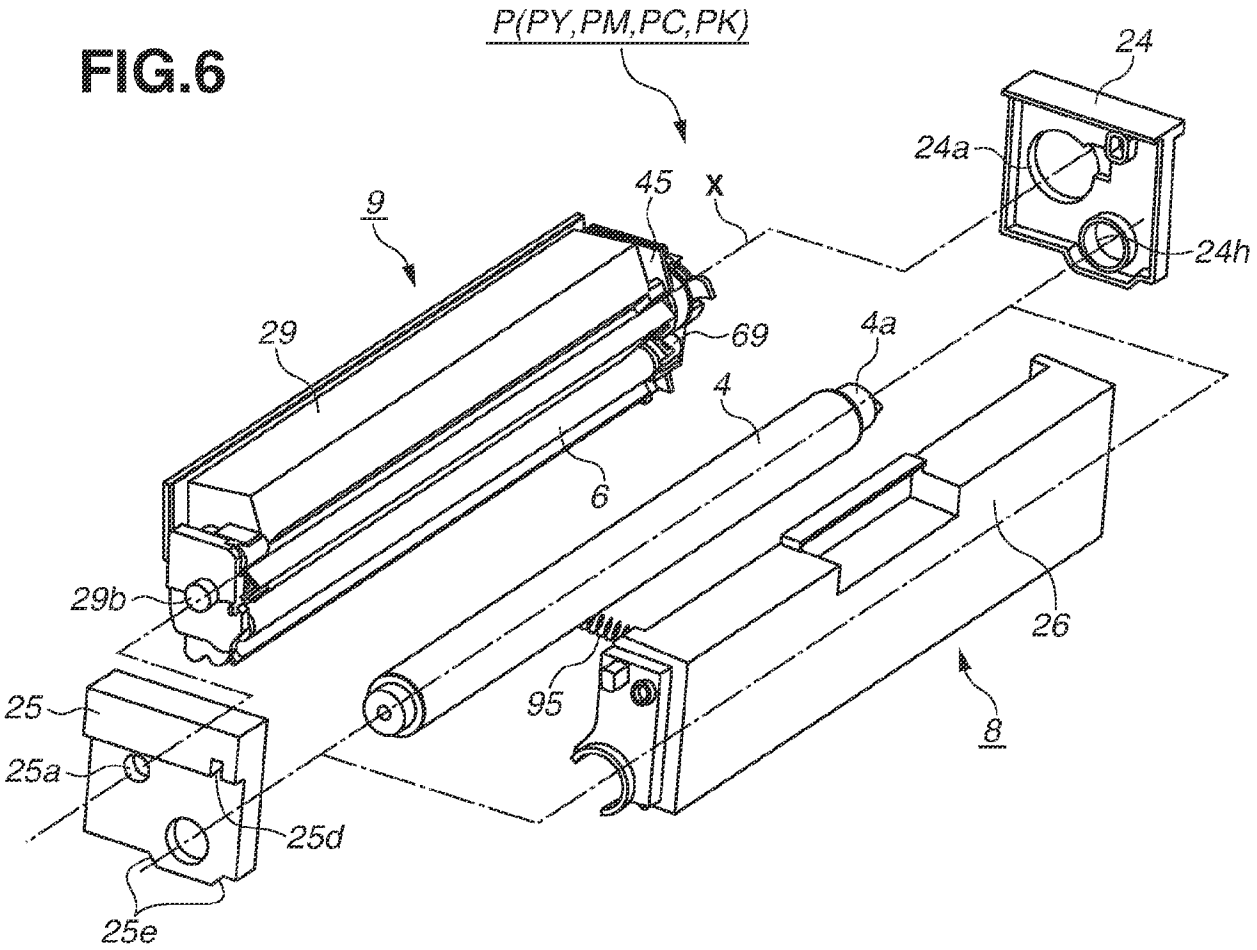
FIG. 6 is an assembling perspective view of the process cartridge according to the first exemplary embodiment.
Figure 16:
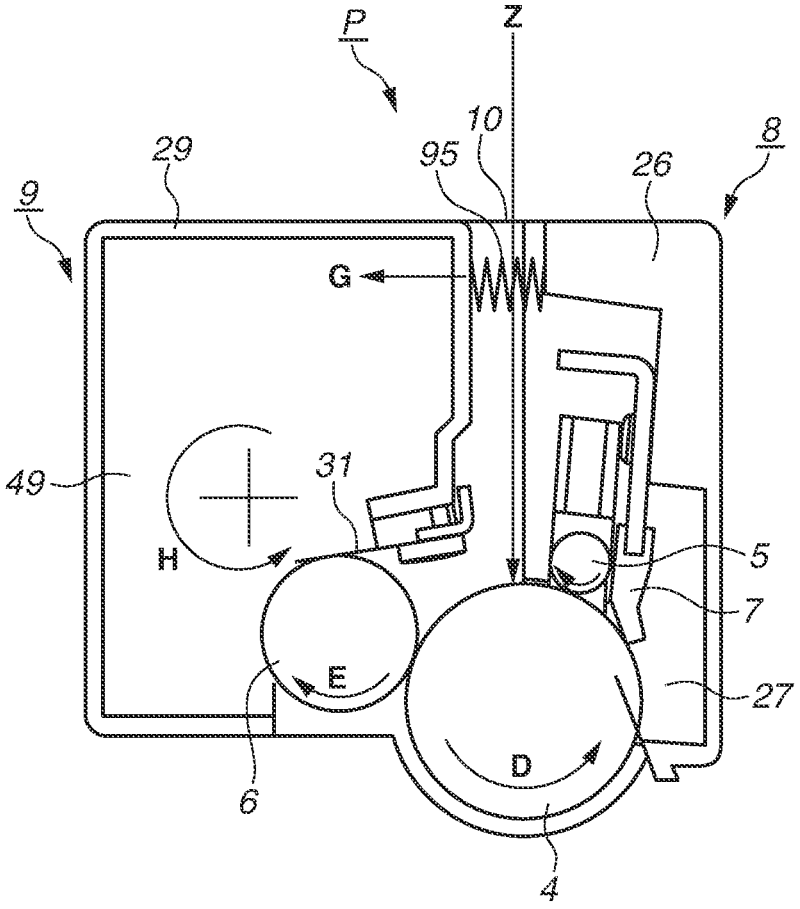
FIG. 16 is a sectional view of the process cartridge according to the first exemplary embodiment.

FIG. 1 is a schematic sectional view of an image forming apparatus 1 according to a first exemplary embodiment of the present invention. FIG. 2A is a sectional view of the image forming apparatus 1 according to the first exemplary embodiment. FIG. 16 is a sectional view of a process cartridge P according to the first exemplary embodiment. FIG. 5 is an assembling perspective view of the process cartridge P as viewed from a driving side. FIG. 6 is an assembling perspective view of the process cartridge P as viewed from a nondriving side.

As illustrated in FIG. 2A, the image forming apparatus 1 is a four-color full-color laser printer using an electrophotographic image forming process and is configured to form a color image on a recording medium S. The image forming apparatus 1 is of the process cartridge type, in which process cartridges are detachably attached to an image forming apparatus body (an apparatus body) 2 to enable forming a color image on the recording medium S.

In the present exemplary embodiment, with regard to the image forming apparatus 1, a side on which a front door 3 is mounted is referred to as a "front surface (anterior surface)", and a side opposite the front surface is referred to as a "back surface (posterior surface)". Furthermore, the right side of the image forming apparatus 1 as viewed from the front surface is referred to as a "driving side", and the left side of the image forming apparatus 1 as viewed from the front surface is referred to as a "nondriving side". In FIG. 1, which is a sectional view as viewed from the nondriving side, the near side on the drawing plane is the nondriving side of the image forming apparatus 1, the right side on the drawing plane is the front surface of the image forming apparatus 1, and the far side on the drawing plane is the driving side of the image forming apparatus 1.

Four process cartridges P (PY, PM, PC, and PK), i.e., a first process cartridge PY, a second process cartridge PM, a third process cartridge PC, and a fourth process cartridge PK, are horizontally arranged in the image forming apparatus body 2.

Furthermore, a structure of the image forming apparatus 1 other than the process cartridges P (PY, PM, PC, and PK) is specifically referred to as an apparatus body (an image forming apparatus body) 2.

The first to fourth process cartridges PY, PM, PC, and PK are image forming units having the same electrophotographic image forming process mechanism. However, the process cartridges PY, PM, PC, and PK are respectively different from one another in the color of toner used for image formation.

Rotational drive force is transmitted from a drive output portion of the image forming apparatus body 2 to each of the first to fourth process cartridges P (PY, PM, PC, and PK). The details thereof are described below.

Furthermore, bias voltages (for example, charging bias and developing bias) are supplied from the image forming apparatus body 2 to the first to fourth process cartridges P (PY, PM, PC, and PK) (although not illustrated).

As illustrated in FIG. 16, each of the first to fourth process cartridges P (PY, PM, PC, and PK) according to the present exemplary embodiment includes a photosensitive drum (hereinafter referred to as a "drum") 4, which serves as an image bearing member (a photosensitive member). The process cartridge P further includes a photosensitive member unit 8, which includes a charging unit, serving as a process unit acting on the drum 4, and a cleaning unit.

Furthermore, each of the first to fourth process cartridges P (PY, PM, PC, and PK) further includes a developing unit 9, which includes a developing portion that develops an electrostatic latent images on the drum 4.

The first process cartridge PY contains a developer of yellow (Y) inside a developing frame body 29, and is used to form a developer image of yellow on the surface of the drum 4.

The second process cartridge PM contains a developer of magenta (M) inside the developing frame body 29, and is used to form a developer image of magenta on the surface of the drum 4.

The third process cartridge PC contains a developer of cyan (C) inside the developing frame body 29, and is used to form a developer image of cyan on the surface of the drum 4.

The fourth process cartridge PK contains a developer of black (K) inside the developing frame body 29, and is used to form a developer image of black on the surface of the drum 4.

A laser scanner unit LB, which serves as an exposure unit, is mounted above the first to fourth process cartridges P (PY, PM, PC, and PK). The laser scanner unit LB outputs laser light Z corresponding to image information. Then, the laser light Z is thrown for scanning and exposure on the surface of the drum 4 after passing through an exposure window portion 10 of the cartridge P.

An intermediate transfer belt unit 11, which serves as a transfer member, is mounted below the first to fourth process cartridges P (PY, PM, PC, and PK). The intermediate transfer belt unit 11 includes a driving roller 13, tension rollers 14 and 15, and a transfer belt having flexibility, which is stretched around the driving roller 13 and the tension rollers 14 and 15.

The respective lower surfaces of the drums 4 of the first to fourth process cartridges P (PY, PM, PC, and PK) are kept in contact with the upper surface of the transfer belt 12. The contact portions between the lower surfaces of the drums 4 and the upper surface of the transfer belt 12 serve as a primary transfer portion. Primary transfer rollers 16 are mounted on the inner side of the transfer belt 12 and opposite the respective drums 4.

Furthermore, a secondary transfer roller 17 is arranged at the position opposite the tension roller 14 via the transfer belt 12. The contact portion between the transfer belt 12 and the secondary transfer roller 17 serves as a secondary transfer portion.

A feeding unit 18 is mounted below the intermediate transfer belt unit 11. The feeding unit 18 includes a paper feeding tray 19, in which the recording medium S is stacked and contained, and a paper feeding roller 20.

A fixing unit 21 and a discharge unit 22 are arranged on the upper left inside the apparatus body 2 in FIG. 1. The top surface of the apparatus body 2 serves as a discharge tray 23.

The recording medium S, to which a developer image has been transferred, is conveyed to the fixing unit 21, at which the developer image is fixed to the recording medium S, and is then discharged to the discharge tray 23.

The cartridge P is configured to be detachably attachable to the apparatus body 2 via a cartridge tray 60, which is able to be pulled out. FIG. 2A illustrates a state in which the cartridge tray 60 and the cartridges P have been pulled out from the apparatus body 2.

[Configuration for Attachment and Detachment]

Next, an attachment and detachment operation of the cartridges P (PY, PM, PC, and PK) to and from the apparatus body 2 is described.

Figure 3:
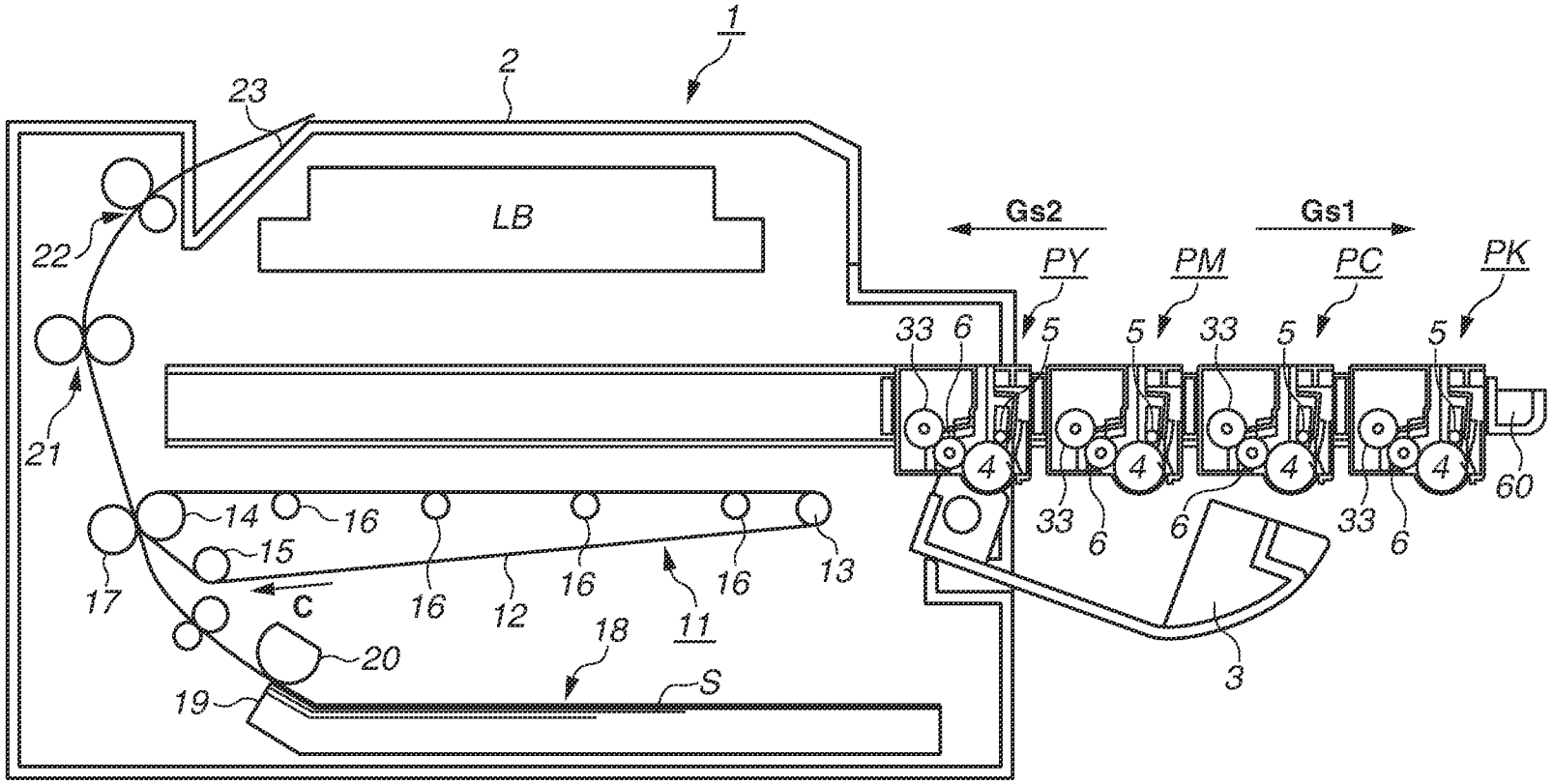
FIG. 3 is a sectional view of the image forming apparatus according to the first exemplary embodiment.
Figure 4:
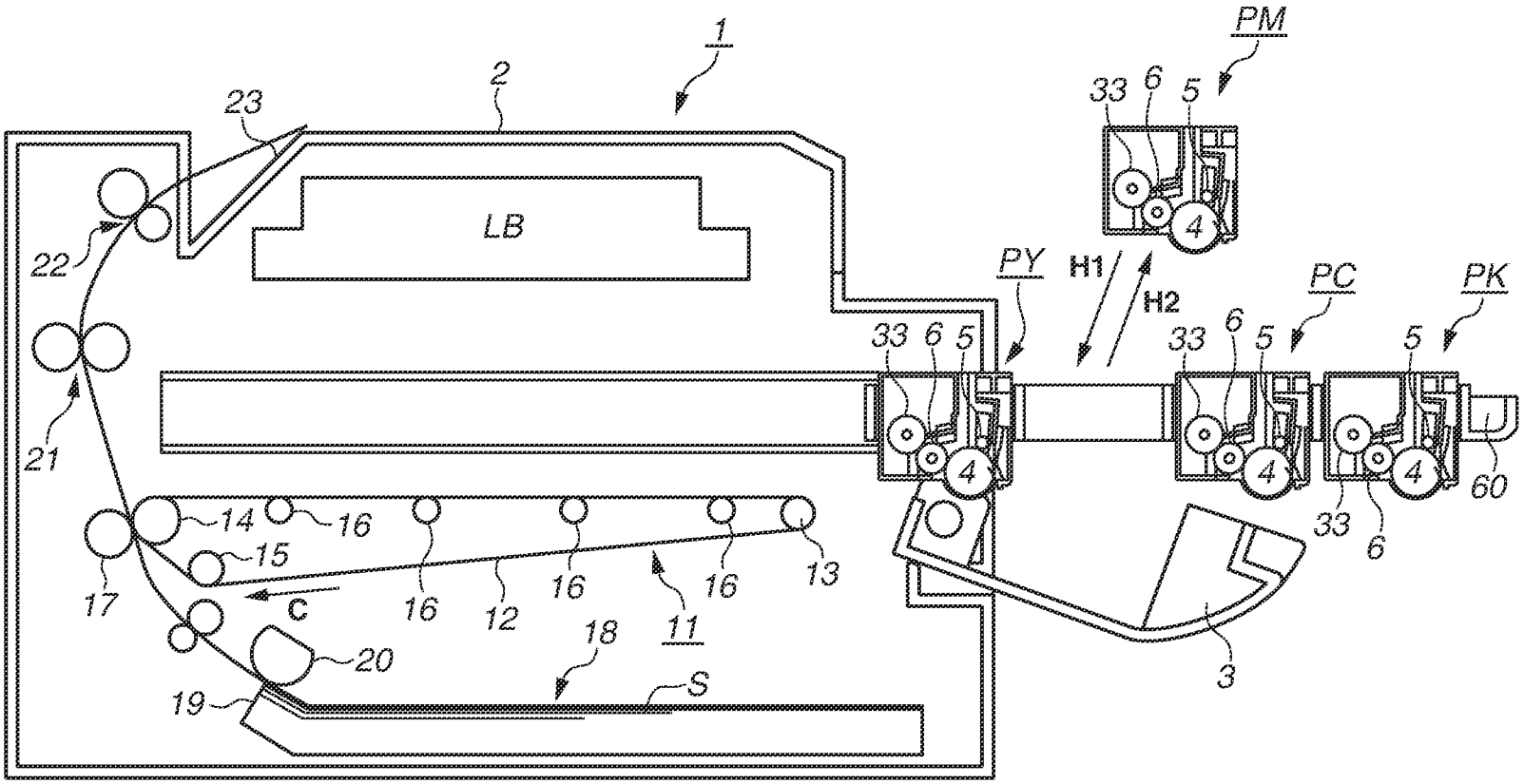
FIG. 4 is a sectional view of the image forming apparatus according to the first exemplary embodiment.

FIG. 2A illustrates a state in which the cartridge tray 60 and the cartridges P have been pulled out from the apparatus body 2, as mentioned above. FIG. 3 is a schematic sectional view illustrating a state in which the cartridge tray 60 has been pulled out from the apparatus body 2 and the cartridges P have become detachable from the apparatus body 2. FIG. 4 is a schematic sectional view illustrating an attachment and detachment operation of the cartridge P to and from the cartridge tray 60.

The cartridge tray 60, to which the cartridges P are attachable, is mounted inside the apparatus body 2. As illustrated in FIG. 3, the cartridge tray 60 is configured to be rectilinearly movable (able to be pushed in and pulled out) in the directions of arrows Gs1 and Gs2, which are substantially horizontal directions, relative to the apparatus body 2. Then, the cartridge tray 60 is able to assume an attachment position, in which the cartridge tray 60 is situated within the apparatus body 2, and a pull-out position, in which the cartridge tray 60 is pulled out from the attachment position.

First, an attachment operation of the cartridge P ((PY, PM, PC, or PK) to the apparatus body 2 is described.

When the user opens the front door 3 and moves the cartridge tray 60 in the direction of arrow Gs1 illustrated in FIG. 3, the cartridge tray 60 is moved to the pull-out position. In this state, when the user attaches the cartridge P to the cartridge tray 60 from the direction of arrow H1 illustrated in FIG. 4, the cartridge P is held by the cartridge tray 60. When the user moves the cartridge tray 60, which holds the cartridge P, in the direction of arrow Gs2 illustrated in FIG. 3, the cartridge tray 60 is moved to the attachment position inside the apparatus body 2. Then, when the user closes the front door 3, the attachment operation of the cartridge P to the apparatus body 2 is complete.

Next, a pull-out operation of the cartridge P from the apparatus body 2 is described. In the same way as in the attachment operation of the cartridge P to the apparatus body 2, the user moves the cartridge tray 60 to the pull-out position. In this state, when the user pulls out the cartridge P in the direction of arrow H2 illustrated in FIG. 4, the pull-out operation of the cartridge P from the apparatus body 2 is complete. With the above-described operations, the cartridge P can be attached to and detached from the apparatus body 2.

[Image Forming Operation]

An operation for forming a full-color image is as follows.

The respective drums 4 of the first to fourth process cartridges P (PY, PM, PC, and PK) are driven to rotate at a predetermined speed (in the direction of arrow D illustrated in FIG. 16, which is counterclockwise in FIG. 1).

The transfer belt 12 is also driven to rotate in a forward direction associated with the rotation of the drums 4 (in the direction of arrow C illustrated in FIG. 1) at a speed corresponding to the rotational speed of the drums 4.

The laser scanner unit LB is also driven. The surface of each drum 4 is uniformly charged with a predetermined polarity and a predetermined potential by a charging roller 5 in synchronization with driving of the laser scanner unit LB. The laser scanner unit LB scans and exposes the surface of each drum 4 with laser light Z according to an image signal for the associated color.

This causes an electrostatic latent image corresponding to an image signal for the associated color to be formed on the surface of each drum 4. The electrostatic latent image is developed by a developing roller 6, which is driven to rotate at a predetermined speed (in the direction of arrow E illustrated in FIG. 16, which is clockwise in FIG. 1). This causes a developer image (a toner image) to be formed on the surface of each drum 4. The drum 4 is an image bearing member that bears an image.

According to the above-described electrophotographic image forming process, a developer image of yellow corresponding to a yellow component of the full-color image is formed on the drum 4 of the first cartridge PY. Then, the developer image of yellow is primarily transferred onto the transfer belt 12.

Likewise, a developer image of magenta corresponding to a magenta component of the full-color image is formed on the drum 4 of the second cartridge PM. Then, the developer image of magenta is primarily transferred onto the transfer belt 12 while being superposed on the developer image of yellow previously transferred onto the transfer belt 12.

Likewise, a developer image of cyan corresponding to a cyan component of the full-color image is formed on the drum 4 of the third cartridge PC. Then, the developer image of cyan is primarily transferred onto the transfer belt 12 while being superposed on the developer image of yellow and the developer image of magenta previously transferred onto the transfer belt 12.

Likewise, a developer image of black corresponding to a black component of the full-color image is formed on the drum 4 of the fourth cartridge PK. Then, the developer image of black is primarily transferred onto the transfer belt 12 while being superposed on the developer image of yellow, the developer image of magenta, and the developer image of cyan previously transferred onto the transfer belt 12.

In this way, a four-color (yellow, magenta, cyan, and black) full-color unfixed developer image is formed on the transfer belt 12.

On the other hand, the recording medium S is separated and fed on a sheet-by-sheet basis at predetermined control timing. Then, the recording medium S is introduced into the secondary transfer portion, which is a contact portion between the secondary transfer roller 17 and the transfer belt 12, at predetermined timing.

According to this operation, during the process in which the recording medium S is conveyed to the secondary transfer portion, a four-color superposed developer image on the transfer belt 12 is sequentially transferred to the surface of the recording medium S in a lump.

[Configuration of a Process Cartridge]

In the present exemplary embodiment, the first to fourth cartridges P (PY, PM, PC, and PK) have the same electrophotographic image forming process mechanism, but differ from one another in the color of a developer contained therein.

The cartridge P includes the drum 4 and a process unit that acts on the drum 4. Here, the process unit includes a charging roller 5 (a charging unit) that charges the drum 4, a developing roller 6 (a developing unit) that develops a latent image formed on the drum 4, a cleaning blade 7 (a cleaning unit) that removes a residual developer remaining on the surface of the drum 4, and other components. Then, the cartridge P is divided into a photosensitive member unit 8 and a developing unit 9.

As illustrated in FIGS. 5, 6, and 16, the photosensitive member unit 8 includes the drum 4, the charging roller 5, and the cleaning blade 7. The photosensitive member unit 8 further includes a cleaning container 26, a waste developer storage portion 27, and a cartridge cover member (a driving-side cartridge cover member 24 and a nondriving-side cartridge cover member 25 illustrated in FIGS. 5 and 6).

The drum 4 is rotatably supported by the cartridge cover members 24 and 25, which serve as end portion members, respectively mounted at both ends in the longitudinal direction of the cartridge P. Here, the axial direction of the drum 4 is defined as the longitudinal direction.

The cartridge cover members 24 and 25 are also photosensitive drum supporting members fixed to the cleaning container 26 at the both end sides in the longitudinal direction of the cleaning container 26.

Figure 2B:
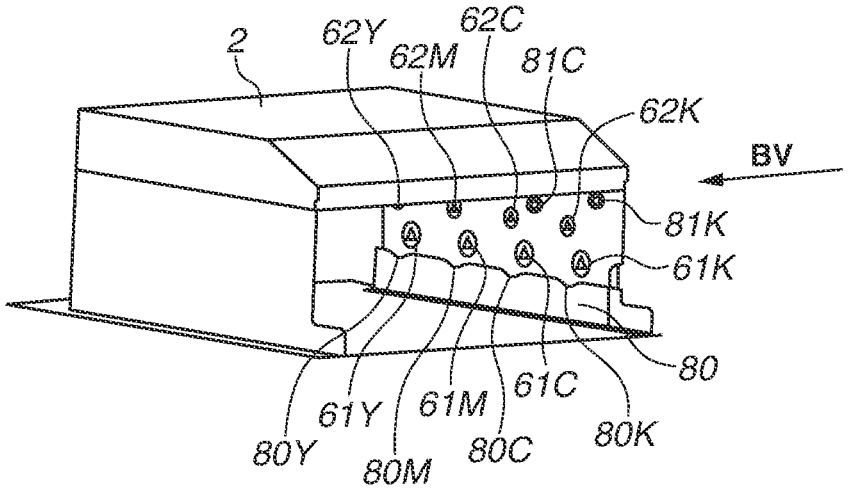

Furthermore, as illustrated in FIG. 5, one end side in the longitudinal direction of the drum 4 is provided with a coupling member 4*a* configured to transmit a drive force to the drum 4. FIG. 2B is a perspective view of the apparatus body 2, in which the cartridge tray 60 and the cartridges P are not illustrated. The respective coupling members 4*a* of the cartridges P (PY, PM, PC, and PK) are engaged with drum drive output members 61 (61Y, 61M, 61C, and 61K) of the apparatus body 2 illustrated in FIG. 2B, so that a drive force from a drive motor (not illustrated) in the apparatus body 2 is transmitted to the drum 4. Thus, the coupling member 4*a* is a drive input portion that receives a drive force from the drum drive output member 61 and transmits the drive force to the drum 4. The coupling member 4*a* is provided at one end portion (an end portion on the driving side) in the axial direction of the drum 4 in the cartridge P. The drum drive output member 61 is a transmission member that transmits a drive force (rotational force) to the drum 4.

The charging roller 5 is supported by the cleaning container 26 in such a manner that the charging roller 5 is able to be driven to rotate in contact with the drum 4.

Furthermore, the cleaning blade 7 is supported by the cleaning container 26 in such a manner that the cleaning blade 7 is kept in contact with the circumferential surface of the drum 4 at a predetermined pressure.

An untransferred developer that has been removed by the cleaning blade 7 from the circumferential surface of the drum 4 is stored in the waste developer storage portion 27 inside the cleaning container 26.

Moreover, supporting hole portions 24*a* and 25*a*, which support the developing unit 9 in such a way as to allow the developing unit 9 to turn, are formed in the driving-side cartridge cover member 24 and the nondriving-side cartridge cover member 25, respectively (see FIGS. 5 and 6).

[Configuration of the Developing Unit]

The developing unit 9 includes, among others, the developing roller 6, a developing blade 31, the developing frame body 29, a bearing member 45, and a developing cover member 32, as illustrated in FIGS. 5, 6, and 16.

Additionally, the bearing member 45 supports the developing roller 6 in such a way as to allow the developing roller 6 to rotate. The developing roller 6 includes, at one end portion in the longitudinal direction thereof, a developing roller gear 69. The bearing member 45 also supports an idler gear (not illustrated), which is configured to transmit a drive force to the developing roller gear 69, in such a way as to allow the idler gear to rotate.

Furthermore, the developing cover member 32 is fixed to the outside of a bearing member (not illustrated) in the longitudinal direction of the developing unit 9. The developing cover member 32 is configured to cover the developing roller gear 69 and a developing input coupling 74. Moreover, the developing cover member 32 is provided with a cylindrical portion 32*b*, as illustrated in FIGS. 5 and 6. A drive input portion 74*b* of the developing input coupling 74 is exposed from the inner opening of the cylindrical portion 32*b*. The drive input portion 74*b* engages with a developing drive output member 62 (62Y, 62M, 62C, or 62K) illustrated in FIG. 2B when the cartridge P (PY, PM, PC, or PK) is attached to the apparatus body 2. Thus, the drive input portion 74*b* is configured to receive a drive force transmitted from a drive motor (not illustrated) mounted in the apparatus body 2. The drive force input to the developing input coupling 74 from the apparatus body 2 is transmitted to the developing roller gear 69 and then to the developing roller 6.

[Assembling of the Photosensitive Member Unit and the Developing Unit]

As illustrated in FIGS. 5 and 6, when the developing unit 9 and the photosensitive member unit 8 are assembled, an outer diameter portion 32*a* of the cylindrical portion 32*b* of the developing cover member 32 is engaged with the supporting hole portion 24*a* of the driving-side cartridge cover member 24 at one end side of the cartridge P. Then, a protruding portion 29*b* formed to protrude from the developing frame body 29 is engaged with the supporting hole portion 25*a* of the nondriving-side cartridge cover member 25 at the other end side of the cartridge P. With this assembling, the developing unit 9 is supported to be able to turn relative to the photosensitive member unit 8. Here, the center of turning of the developing unit 9 relative to the photosensitive member unit 8 is referred to as an axis line X. The axis line X is a line connecting the center of the supporting hole portion 24*a* and the center of the supporting hole portion 25*a*.

[Orientation of the Developing Unit]

As illustrated in FIGS. 5, 6, and 16, the developing unit 9 is configured to be urged by a pressure spring 95, which serves as an elastic member, in such a way as to bring the developing roller 6 into contact with the drum 4 by turning around the axis line X. Thus, the developing unit 9 is pressed in the direction of arrow G illustrated in FIG. 16, so that a moment in the direction of arrow H acts on the developing unit 9 around the axis line X.

This enables the developing roller 6 to contact the drum 4 at a predetermined pressure. Furthermore, the position of the developing unit 9 relative to the photosensitive member unit 8 at this time is referred to as a "contact position".

Figure 15A:
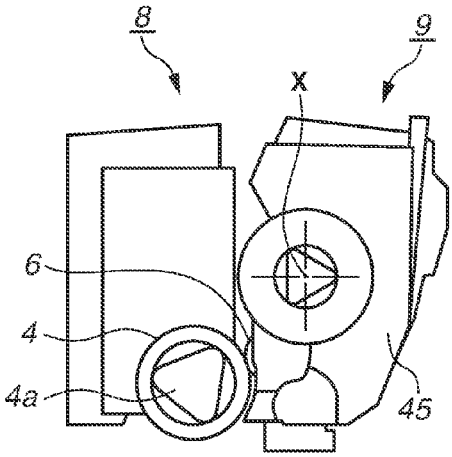
FIGS. 15A and 15B are sectional views of the process cartridge according to the first exemplary embodiment.
Figure 15B:
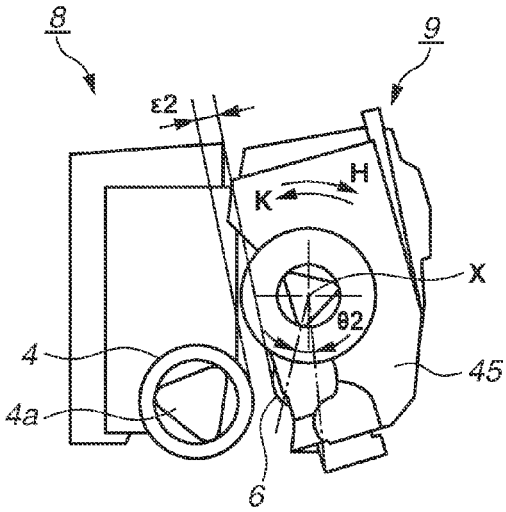

FIGS. 15A and 15B are side views of the cartridge P as viewed from the driving side. In FIGS. 15A and 15B, for ease of description, some components are not illustrated. When the cartridge P is attached to the apparatus body 2, the photosensitive member unit 8 is fixed in position to the apparatus body 2.

FIG. 15A illustrates the above-mentioned state in which the drum 4 and the developing roller 6 are in contact with each other.

FIG. 15B illustrates a state in which the drum 4 and the developing roller 6 are away from each other. The developing unit 9 is in the state of having turned by an angle θ2 in the direction of arrow K around the axis line X under a force (not illustrated) from the apparatus body 2. At this time, the drum 4 and the developing roller 6 are in the state of being way from each other by a distance ϵ2.

Drive trains in the image forming apparatus body 2 are described with reference to FIG. 2B and FIG. 7.

As illustrated in FIG. 2B, developing drive output members 62 (62Y, 62M, 62C, and 62K) and drum drive output members 61 (61Y, 61M, 61C, and 61K) are rotatably and integrally mounted on the image forming apparatus body 2.

Figure 7:
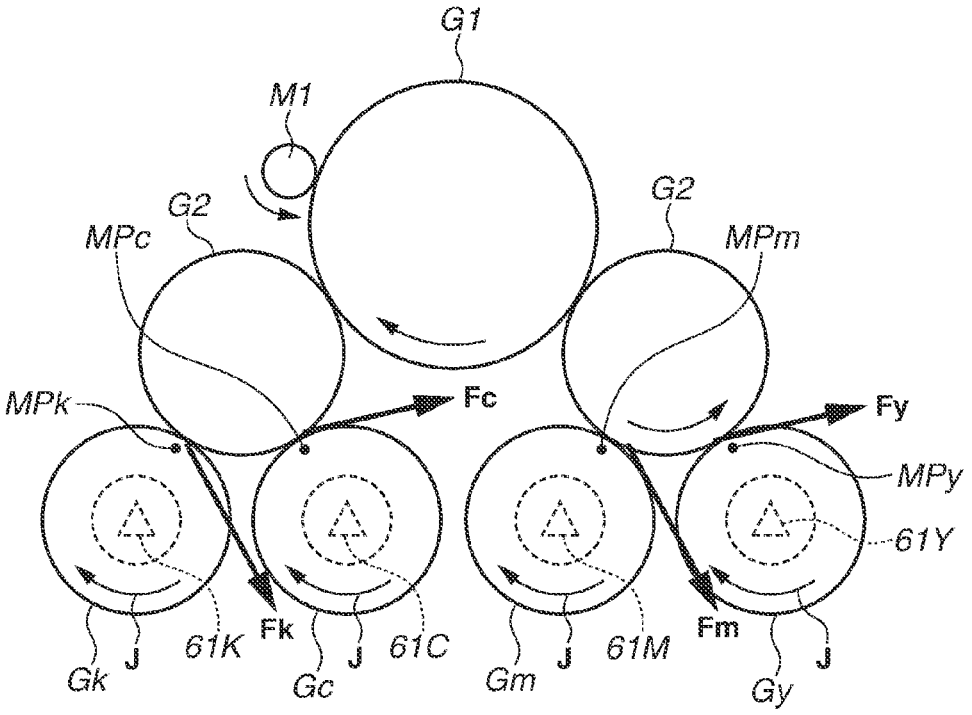
FIG. 7 is a schematic diagram of a drive portion in an image forming apparatus body according to the first exemplary embodiment.

As illustrated in FIG. 7, the drum drive output members 61 transmit drive forces with a plurality of gear trains G1, G2, and G (with regard to gears GY, GM, GC, and GK, which have the same configuration, being referred to as "G" unless otherwise stated) in such a manner that the drive force from a motor M1 is distributed to each of the drum drive output members 61.

The location of the photosensitive drum 4 and the drum drive output member 61 is described with reference to FIGS. 8A and 8B.

The photosensitive drum 4 includes a hollow columnar (drum-shaped) portion (columnar portion) 4*d*, a shaft portion 4*a*1 provided at one end side in the axial direction, and a shaft portion 4*b*1 provided at the other end side in the axial direction. A photosensitive layer is provided on the surface of the columnar portion 4*d*, on which a latent image can be formed. The shaft portions 4*a*1 and 4*b*1 are smaller in diameter than the columnar portion 4*d*.

A coupling member 4*a*, which is configured to receive a drive force from the drum drive output member 61, is integrally formed at the fore end of the shaft portion 4*a*1. The drum drive output member 61, which engages with the coupling member 4*a*, is formed integrally with the gear 5 and is mounted on the side of the image forming apparatus body 2. The coupling member 4*a* and the drum drive output member 61 are able to engage with and disengage from each other.

As described below, during an image forming operation after the process cartridge P is set in a predetermined position, the photosensitive drum 4, the coupling member 4*a* of which is connected to (engaged with) the drum drive output member 61, rotates integrally with the drum drive output member 61 on the side of the apparatus body 2.

In the state in which the process cartridges P are set in the image forming apparatus body 2 as illustrated in FIG. 1, the process cartridges P respectively engage with positioning portions 80Y, 80M, 80C, and 80K of a stay 80 mounted integrally with the image forming apparatus body 2 illustrated in FIG. 2B.

Figure 10A:
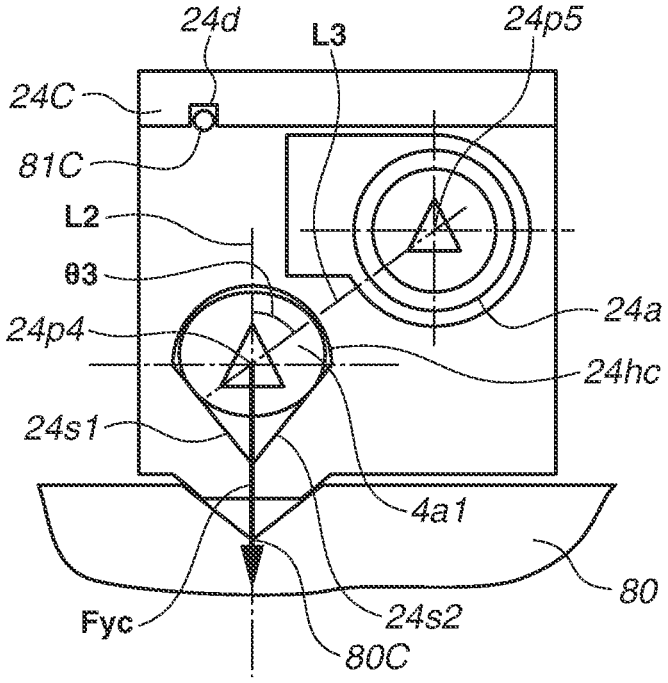
FIGS. 10A and 10B are schematic diagrams illustrating the vicinity of a drive input portion according to the first exemplary embodiment.

Furthermore, as illustrated in FIG. 10A, a rotation positioning groove 24*d* (FIGS. 5 and 10A) of the process cartridge P engages with a cartridge rotation positioning boss 81C mounted integrally with the image forming apparatus body 2.

Forces acting on the drum 4 during an image forming operation are described with reference to FIGS. 7 to 11.

First, directions of forces which the drum drive output member 61 exerts on the photosensitive drum 4 are described with reference to FIG. 7.

As mentioned in the foregoing, a drive force from the motor M1 is transmitted to the drum drive output member 61 via the idler gear G1 and the idler gear G2 in such a manner that the drive force is distributed to each of the drum drive output members 61.

Furthermore, since the drum drive output member receives a drive force in the direction of arrow J integrally with the photosensitive drum 4 as described above, forces which the photosensitive drums 4 receive respectively act in the directions of intermeshing pressure angles Fy, Fm, Fc, and Fk between the idler gears G2 and the gears G (Gy, Gm, Fc, and Gk).

In a case where a single motor M1 is used to drive a plurality of (in this case, four) photosensitive drums 4 as illustrated in FIG. 7, if the vectors of intermeshing forces are denoted by Fy, Fm, Fc, and Fk, the intermeshing forces between the idler gears G2 and the gears G act in a plurality of directions due to the layout of gears. In the present exemplary embodiment, the vectors of intermeshing forces Fy, Fm, Fc, and Fk are in such a relationship that Fy=Fc and Fm=Fk with respect to the directions of intermeshing forces.

Thus, two types of vectors act on the photosensitive drums 4.

The reason why two types of vectors exist is as follows. Suppose that an intermeshing point at which the gear Gk and the corresponding idler gear G2 intermesh as viewed from the axial direction of the photosensitive drum 4 of the cartridge Pk be denoted by MPk. Suppose that an intermeshing point at which the gear Gc and the corresponding idler gear G2 intermesh as viewed from the axial direction of the photosensitive drum 4 of the cartridge Pc be denoted by MPc. The gears Gk and Gc and the idler gear G2 are arranged as illustrated in FIG. 7. Similarly, suppose that intermeshing points for the gears Gm and Gy be denoted by MPm and MPy, respectively. Then, the phase of the intermeshing point MPk for the gear Gk is different from the phase of the intermeshing point MPc for the gear Gc. On the other hand, the phase of the intermeshing point MPk for the gear Gk is the same as the phase of the intermeshing point MPm for the gear Gm, and the phase of the intermeshing point MPc for the gear Gc is the same as the phase of the intermeshing point MPy for the gear Gy. Therefore, the directions of the vectors Fy, Fm, Fc, and Fk are in the above-mentioned relationship.

Next, directions of forces which all of the photosensitive drums 4 receive including the above-mentioned intermeshing forces are described with reference to FIGS. 9A, 9B, 9C, and 9D.

Furthermore, in the present exemplary embodiment, since the intermeshing forces act in the same direction for the process cartridges PC and PY, the process cartridges PK and PM have the same configuration with regard to forces which the process cartridges P receive. Moreover, the process cartridges PC and PY also have the same configuration. Therefore, the process cartridges PC and PY are collectively referred to as a "first image forming unit". Additionally, the process cartridges PK and PM are collectively referred to as a "second image forming unit".

In the following description, the process cartridge PC is taken as an example of the first image forming unit, and the process cartridge PK is taken as an example of the second image forming unit.

FIGS. 9A, 9B, 9C, and 9D are enlarged sectional views of the photosensitive drum 4 and its neighboring components in the process cartridge P illustrated in FIG. 1 taken along the direction perpendicular to the axial direction of the photosensitive drum 4 as viewed from the direction of arrow BV (FIG. 2B).

Figure 9A:
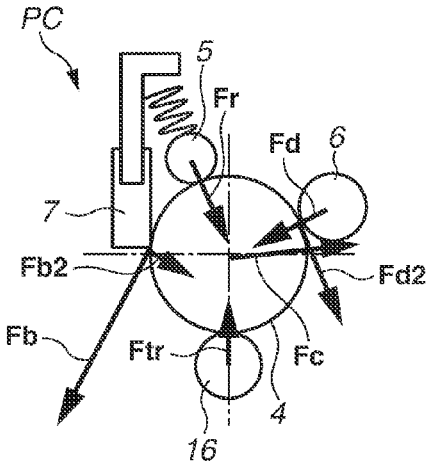
FIGS. 9A, 9B, 9C, and 9D are schematic diagrams illustrating the vicinity of the photosensitive drum portion according to the first exemplary embodiment.

The forces acting on the photosensitive drum 4, which rotates in the direction of arrow V, in the case of the process cartridge PC include a force Fb that is caused by the frictional resistance of the cleaning blade 7, a reaction force Fb2 that occurs when the cleaning blade 7 bends, a force Fr that is a pressure force of the charging roller 5, and a pressure force Fd of the developing roller 6. Moreover, since the surface speed of the developing roller 6, which rotates in the direction of arrow W, is higher than that of the photosensitive drum 4, which rotates in the direction of arrow V, a frictional force Fd2 that occurs between the surfaces of the developing roller 6 and the photosensitive drum 4 acts on the photosensitive drum 4. Furthermore, a pressure force Ftr of the primary transfer roller 16 and the above-mentioned intermeshing force Fc (=Fy) also act on the photosensitive drum 4, as illustrated in FIG. 9A. The cleaning blade 7, the charging roller 5, the developing roller 6, and the primary transfer roller 16 are contact members that contact the surface of the photosensitive drum 4.

Additionally, it is supposed that, since the surface speed of each of the charging roller 5 and the primary transfer roller 4 is approximately equal to that of the photosensitive drum 4, no frictional force occurs therebetween. Even in a case where there is a difference in surface speed, it may be taken into consideration that the photosensitive drum 4 receives a frictional force from such a member.

Figure 9B:
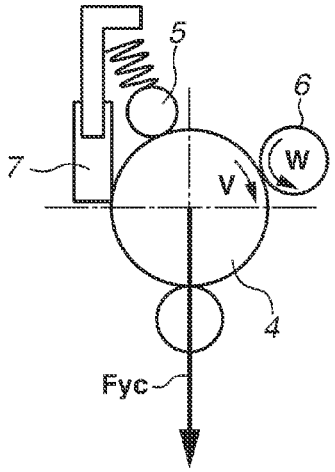
Figure 9C:
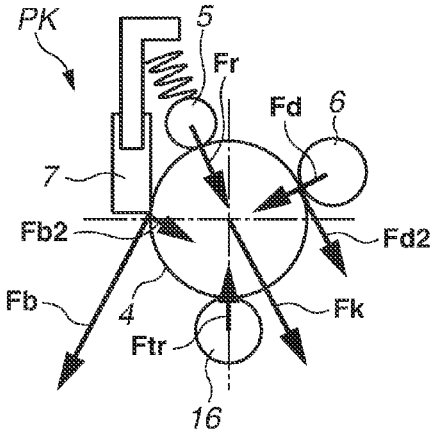

Similarly, also in the case of the process cartridge PK, the forces Fb, Fb2, Fr, Fd, Fd2, and Ftr from the cleaning blade 7, the charging roller 5, the developing roller 6, and the primary transfer roller 16 and the above-mentioned intermeshing force Fk (=Fm) act on the photosensitive drum 4, as illustrated in FIG. 9C.

These forces act on the photosensitive drum 4 during an image forming operation.

Also in the case of the process cartridge PM, the same forces in direction and amount as in the case of the process cartridge PK act on the photosensitive drum 4 except the above-mentioned intermeshing force Fk. The details thereof are not repeated here.

Figure 9D:
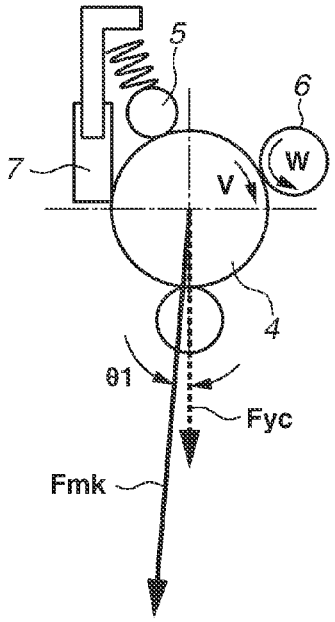

Then, resultant forces Fyc and Fmk, which are the results of the above-mentioned forces, act on the photosensitive drum 4 in the process cartridges PC and PK as illustrated in FIGS. 9B and 9D, respectively.

Thus, the resulting forces acting on the photosensitive drum 4 in the process cartridge P are directed in different directions according to the arrangement of gears from the motor M to the drum drive output shaft in the image forming apparatus body 2 (see an angle θ1 illustrated in FIG. 9D).

The driving-side cartridge cover member 24 (24C or 24K) is described in detail with reference to FIG. 6 and FIGS. 10A and 10B.

FIG. 10A is an enlarged view of the vicinity of the driving-side cartridge cover 24C of the process cartridge PC.

Figure 10B:
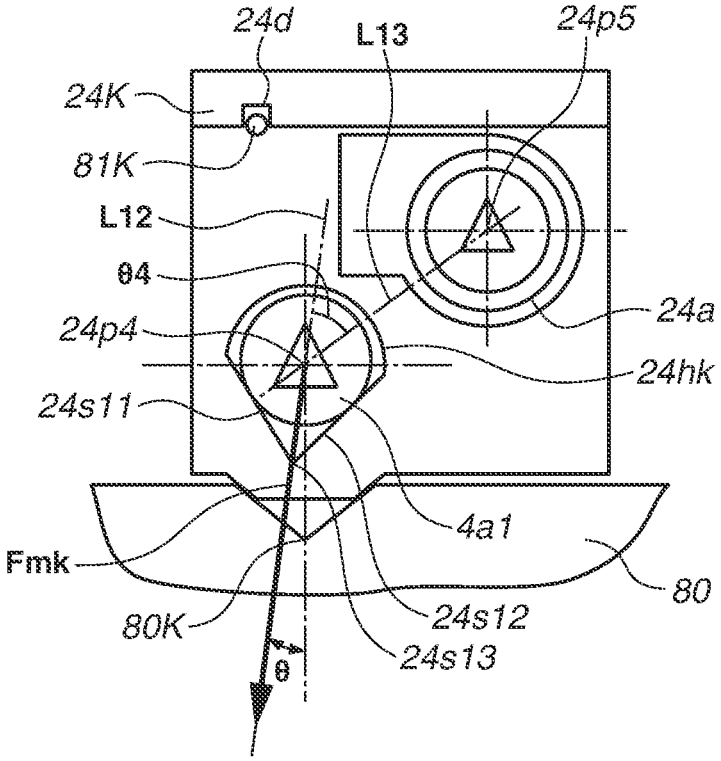

FIG. 10B is an enlarged view of the vicinity of the driving-side cartridge cover 24C of the process cartridge PK.

First, the driving-side cartridge cover 24C is described.

The driving-side cartridge cover 24C has a hole 24*hc*, which is used to support the shaft portion 4*a*1 of the photosensitive drum 4, as illustrated in FIG. 10A. A part of the inner circumference surface of the hole 24*hc* has a pair of inclined flat surface portions 24*s*1 and 24*s*2. The flat surface portions 24*s*1 and 24*s*2 serve as a supporting portion that supports one end portion side (the driving side) in the axial direction of the drum 4.

The inclinations of the flat surface portions 24*s*1 and 24*s*2 are set in such a manner that the above-mentioned resultant force Fyc is received by the flat surface portions 24*s*1 and 24*s*2. Furthermore, although details are described below, forces that the flat surface portions 24*s*1 and 24*s*2 receive can be distributed equally. However, those forces do not always need to be distributed equally.

Moreover, similar flat surface portions 24*s*11 and 24*s*12 are provided also in the driving-side cartridge cover 24K of the process cartridge PK, as illustrated in FIG. 10B.

The setting of inclinations of the flat surface portions 24*s* (24*s*1, 24*s*2, 24*s*11, and 24*s*12) is described with reference to FIGS. 14A, 14B, and 14C.

Figure 14A:
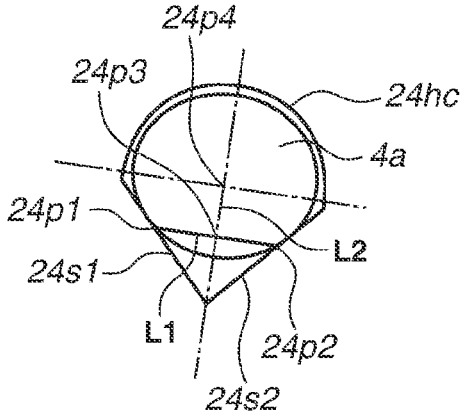
FIGS. 14A, 14B, and 14C are enlarged schematic diagrams illustrating the vicinity of the photosensitive drum portion according to the first exemplary embodiment.

FIG. 14A is an enlarged view of the vicinity of the hole 24*hc* provided in the driving-side cartridge cover 24C of the process cartridge PC. In particular, FIG. 14A illustrates a virtual cross section of the process cartridge PC. The virtual cross section is perpendicular to the axial direction of the photosensitive drum 4.

The shaft portion 4*a*1 of the photosensitive drum 4 is supported by contacting the flat surface portions 24*s*1 and 24*s*2 at a first contact point (a first supporting portion) 24*p*1 and a second contact point (a second supporting portion) 24*p*2, respectively. Furthermore, a portion of contact between the shaft portion 4*a*1 and the flat surface portion 24*s*1 (24*s*2) is actually not a point, but a straight line extending in the direction perpendicular to the cross section illustrated in FIG. 14A.

In the cross section illustrated in FIG. 14A, a first line segment connecting the contact point 24*p*1 and the contact point 24*p*2 is denoted by L1, and a second line segment connecting a midpoint 24*p*3 of the first line segment L1 and a point 24*p*4, which is the center of the axis line of the photosensitive drum 4, is denoted by L2 (a first straight line). The midpoint 24*p*3 is a middle point between the first contact point 24*p*1 and the second contact point 24*p*2. The inclinations of the flat surface portions 24*s*1 and 24*s*2 are set in such a manner that the line segment L2 is approximately parallel to the above-mentioned resultant force Fyc (see FIG. 9B). Therefore, the resultant force Fyc, which is exerted on the driving-side cartridge cover 24C when the photosensitive drum 4 is rotating, is distributed to the contact point (the first supporting portion) 24*p*1 and the contact point (the second supporting portion) 24*p*2 in a good balance. The driving-side cartridge cover 24C is able to stably support the photosensitive drum 4.

Figure 14B:
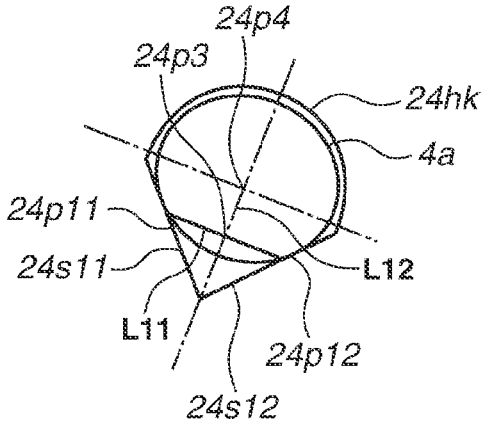

Similarly, in the case of the process cartridge PK, the inclinations of the inclined flat surface portions 24*s*11 and 24*s*12 of the driving-side cartridge cover 24K are determined according to the direction of the resultant force Fmk, as illustrated in FIG. 14B. The details thereof are described below. Thus, in the case of the process cartridge PK, the first line segment is denoted by L11 and the second line segment is denoted by L12 (a second straight line), and the second straight line L12 is made approximately parallel to the line segment of the resultant force Fmk. As a result, the resultant force Fmk, which the driving-side cartridge cover 24K receives, is distributed to the contact point (the third supporting portion) 24*p*11 and the contact point (the fourth supporting portion) 24*p*12 in a good balance.

Figure 14C:
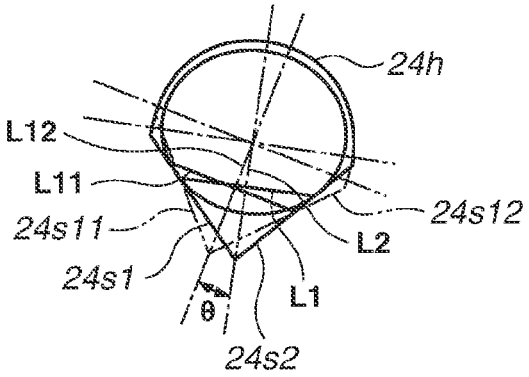

FIG. 14C is a diagram obtained by superposing FIG. 14A and FIG. 14B. In FIG. 14C, the flat surface portions 24*s*1 and 24*s*2 are indicated by solid lines, and the flat surface portions 24*s*11 and 24*s*12 are indicated by two-dot chain lines.

Then, the first straight line L2, which is the second line segment in the process cartridge PC, and the second straight line L12, which is the second line segment in the process cartridge PK, make an angle θ and are not parallel to each other. Thus, the flat surface portions 24*s* (24*s*1, 24*s*2, 24*s*11, and 24*s*12) of the holes 24*h* (24*hc* and 24*hk*) differ depending on each process cartridge (or the position in which each process cartridge is fixed in position).

Among a plurality of cartridges PY, PM, PC, and PK (a cartridge group), the first straight line L2 in the cartridges PC and PY (the first image forming unit) is inclined in a predetermined direction corresponding to the inclination of the resultant force Fyc. On the other hand, the second straight line L12 in the cartridges PM and PK (the second image forming unit) is inclined in a direction different from the predetermined direction and corresponding to the inclination of the resultant force Fmk.

The direction of the resultant force (a first resultant force) Fyc, which the driving-side cartridge covers 24C and 24Y of the respective cartridges PC and PY receive, is different from the direction of the resultant force (a second resultant force) Fmk, which the driving-side cartridge covers 24M and 24K of the respective cartridges PM and PK receive. Thus, as understandable from FIGS. 10A and 10B, the resultant force (the second resultant force) Fmk, which the driving-side cartridge covers 24M and 24K receive, is inclined clockwise relative to the resultant force (the first resultant force) Fyc, which the driving-side cartridge covers 24C and 24Y receive. Therefore, the second straight line L12 in the driving-side cartridge covers 24M and 24K is also made to be inclined clockwise relative to the first straight line L2 in the driving-side cartridge covers 24C and 24Y (i.e., in the same direction as the direction in which the resultant force Fmk is inclined relative to the resultant force Fyc).

Figure 11A:
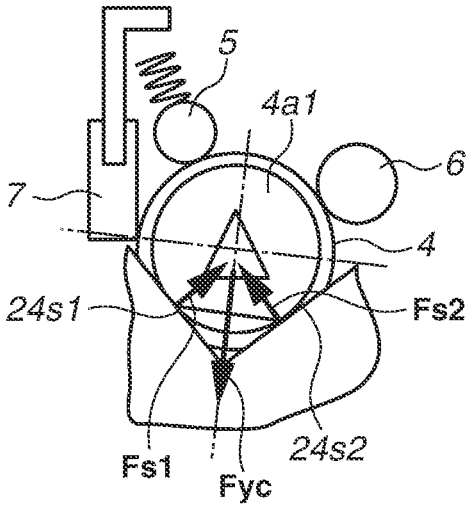
FIGS. 11A and 11B are enlarged schematic diagrams illustrating the vicinity of the photosensitive drum portion according to the first exemplary embodiment.

Furthermore, while, in the present exemplary embodiment, an example is described in which the line segment L2 is parallel to the resultant force Fyc, this example is based on a case where reaction forces Fs1 and Fs2 received from the respective flat surface portions 24*s*1 and 24*s*2 are equal to each other, as illustrated in FIG. 11A.

With this configuration, since the resultant force Fyc is approximately equally received by the flat surface portions 24*s*1 and 24*s*2, any deformation or abrasion of the flat surface portions 24*s*1 and 24*s*2 can be made more equal. Thus, even when the used time of a photosensitive drum has increased, such configuration can advantageously prevent the position of the photosensitive drum from varying.

As another example, the line segment L2 and the resultant force Fyc do not always need to be parallel to each other. Even if the direction of the line segment L2 is merely changed relatively according to the direction of a resultant force acting on the photosensitive drum 4, an advantageous effect can be obtained.

Furthermore, the present exemplary embodiment can be considered from another point of view. This point is described. In FIG. 10A, which illustrates the state of the vicinity of the driving-side cartridge cover 24C as viewed from the axial direction of the photosensitive drum 4, an angle made by the first straight line L2, which is parallel to the vector of the resultant force Fyc, with a straight line L3, which connects the rotational center 24*p*4 of the photosensitive drum 4 and the rotational center 24*p*5 of the developing roller 6, is denoted by θ3 (a first angle). In FIG. 10B, which illustrates the state of the vicinity of the driving-side cartridge cover 24K as viewed from the axial direction of the photosensitive drum 4, an angle made by the second straight line L12, which is parallel to the vector of the resultant force Fmk, with a straight line L13, which connects the rotational center 24*p*4 of the photosensitive drum 4 and the rotational center 24*p*5 of the developing roller 6, is denoted by θ4 (a second angle). Then, the driving-side cartridge cover 24C and the driving-side cartridge cover 24K are configured in such a manner that the angle θ3 and the angle θ4 are different from each other. In the present exemplary embodiment, when the absolute value of a difference between the angle θ3 and the angle θ4 is denoted by Δθ ($0° < \Delta\theta \leq 180°$), the absolute value Δθ is set to 15°. Furthermore, in the present exemplary embodiment, since the straight line L3 and the straight line L13 are parallel to each other, the absolute value Δθ coincides with an angle θ (see FIG. 14C) made by the vector of the resultant force Fmk with the vector of the resultant force Fyc. Moreover, the absolute value Δθ may be greater than 15°.

Figure 11B:
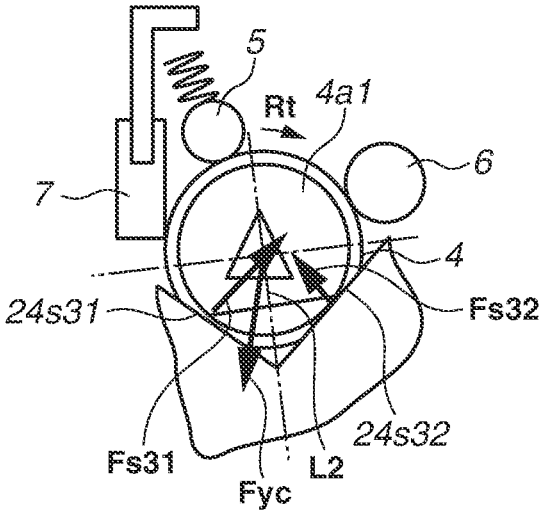

FIG. 11B illustrates a configuration of a process cartridge obtained by partially modifying the present exemplary embodiment. In the configuration illustrated in FIG. 11B, the first straight line L2 and the direction of the resultant force Fyc are not parallel to each other. In a case where the process cartridge has such a configuration, it is desirable that the line segment L2 is set to be inclined toward the upstream side (in FIG. 11B, counterclockwise) in the rotational direction Rt of the photosensitive drum 4 relative to the resultant force Fcy. This is because, in order to stably support the photosensitive drum 4, it is desirable that a load applied to a flat surface portion 24*s*31, which is located at the downstream side in the rotational direction of the photosensitive drum 4 among two flat surface portions 24*s*31 and 24*s*32, is larger than a load applied to the flat surface portion 24*s*32.

Furthermore, in this case, the flat surface portions 24*s*31 and 24*s*32 are set in such a manner that either one of reaction forces Fs31 and Fs32 does not become zero.

Moreover, while the present exemplary embodiment is described with regard to the driving-side cartridge cover member 24, the nondriving-side cartridge cover member does not need to have such a configuration that the above-mentioned directions differ with each process cartridge, since no intermeshing forces act on the nondriving-side cartridge cover member 25.

Finally, the configuration of the present exemplary embodiment can be summarized as follows.

The image forming apparatus 1 can be provided with a plurality of cartridges (image forming units) P (see FIG. 1).

Each of the plurality of cartridges P includes a drum (an image bearing member) 4, which is configured to bear a developer image, and a cartridge cover member (a supporting member) 24 (24Y, 24M, 24C, or 24K), which is configured to support one end side of the drum 4 in the longitudinal direction thereof (see FIG. 5). The drum 4 includes a cylindrical portion 4*d*, which has a photosensitive layer, and a shaft portion 4*a*1, which is smaller in diameter than the cylindrical portion 4*d*, and the cartridge cover member 24 supports the shaft portion 4*a*1 (see FIGS. 8A and 8B and FIGS. 10A and 10B).

More specifically, in a virtual cross section perpendicular to the axis line of the drum 4, the cartridge cover member 24 supports the shaft portion 4*a*1 of the drum 4 at a contact point 24*p*1 (a first supporting portion) and a contact point 24*p*2 (a second supporting portion) or at a contact point 24*p*11 (a third supporting portion) and a contact point 24*p*12 (a fourth supporting portion) (see FIGS. 14A and 14B).

In the cross section, a line segment connecting the contact point 24*p*1 and the contact point 24*p*2 is referred to as a first line segment L1. In the cross section, a line segment connecting the contact point 24*p*11 and the contact point 24*p*12 is referred to as a first line segment L11. Furthermore, in the cross section, a straight line connecting a midpoint 24*p*3 of the first line segment L1 and the rotational center of the drum 4 is referred to as a first straight line L2. In the cross section, a straight line connecting a midpoint 24*p*3 of the first line segment L1 and the rotational center of the drum 4 is referred to as a second straight line L12 (see FIGS. 14A and 14B).

The plurality of cartridges P includes at least cartridges PC and PY, which serve as a first image forming unit, and cartridges PM and PK, which serve as a second image forming unit. The photosensitive drum 4 of the cartridge PC or PY is referred to as a first photosensitive drum 4, and a coupling member 4*a* thereof is referred to as a first drive input portion. The photosensitive drum 4 of the cartridge PM or PK is referred to as a second photosensitive drum 4, and a coupling member 4*a* thereof is referred to as a second drive input portion. In the first image forming unit (the cartridges PC and PY), the first straight line L2 is inclined in a predetermined direction (see FIG. 14A). In the second image forming unit (the cartridges PM and PK), the second straight line L12 is inclined in a direction different from the predetermined direction (see FIG. 14B).

When the drum 4 is rotating in each cartridge P, a resultant force which the cartridge cover 24C (24Y) receives from the drum 4 in the cartridge PC (PY) is denoted by Fyc (FIG. 10A). Moreover, a resultant force which the cartridge cover 24K (24M) receives from the drum 4 in the cartridge PK (PM) is denoted by Fmk (FIG. 10B). Then, the resultant forces Fyc and Fmk differ in direction.

The direction in which the second straight line L12 in the cartridges PK and PM (the second image forming unit) is inclined relative to the first straight line L2 in the cartridges PY and PC (the first image forming unit) is the same as the direction in which the second resultant force (Fmk) is inclined relative to the first resultant force (Fyc). This is as illustrated in FIGS. 10A and 10B and FIGS. 14A, 14B, and 14C.

Thus, the positions of the contact points 24*p*1 and 24*p*2 and the positions of the contact points 24*p*11 and 24*p*12 are determined according to the respective resultant forces Fyc and Fmk. Since a load applied to the cartridge cover member 24, which supports the drum 4, is distributed to two contact points in a good balance, the durability of the cartridge cover member 24 can be improved, so that the cartridge cover member 24 can stably support the drum 4 over a long period of time.

The apparatus body 2 of the image forming apparatus 1 includes a plurality of drum drive output members (transmission members) 61 (61Y, 61M, 61C, and 61K) corresponding to the drums 4 of the respective process cartridges P (see FIG. 2B).

Figure 8A:
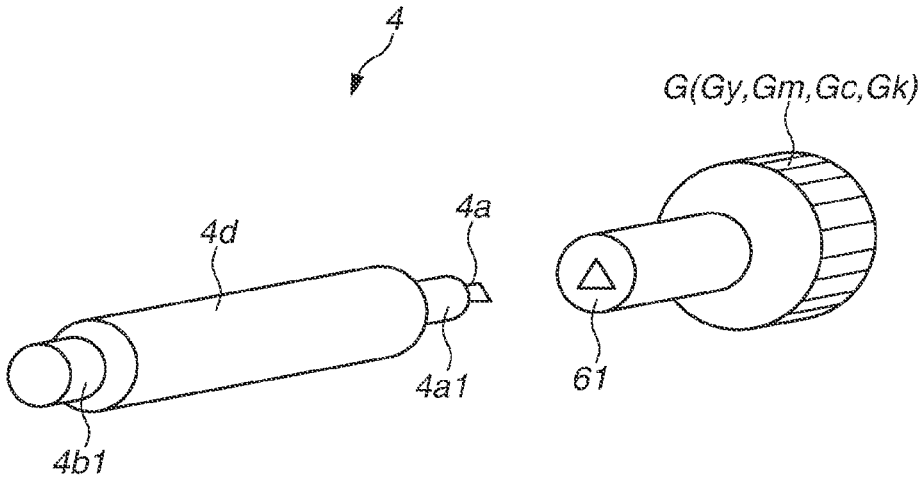
FIGS. 8A and 8B are schematic diagrams illustrating the vicinity of a photosensitive drum portion according to the first exemplary embodiment.
Figure 8B:
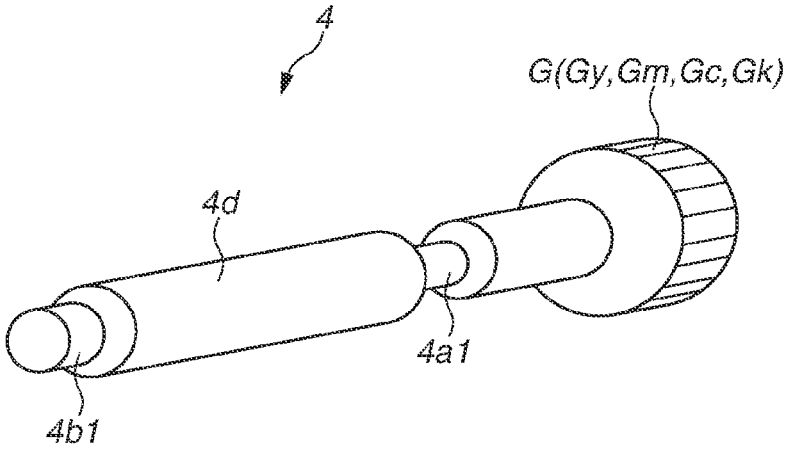

The drum 4 includes a coupling 4*a*1, which is able to engage with and disengage from the drum drive output member 61, at one end side of the drum 4 (see FIGS. 8A and 8B). The drum 4 receives a drive force transmitted from the one end side via the coupling 4*a*1.

The drum drive output members 61C and 61Y, which transmit drive forces to the cartridges PC and PY (the first image forming unit), respectively, are referred to as a first transmission member, and the drum drive output members 61K and 61M, which transmit drive forces to the cartridges PK and PM (the second image forming unit), respectively, are referred to as a second transmission member. At this time, a gear Gc (Gy) mounted on the first transmission member 61C (61Y) is referred to as a first gear, and a gear Gk (Gm) mounted on the second transmission member 61K (61M) is referred to as a second gear (see FIG. 7).

The first gear Gc and the second gear Gk engage with a common idler gear (a third gear) G2 and receive a drive force from the common idler gear G2 (see FIG. 7). Thus, the idler gear G2 engages with both the first gear Gc and the second gear Gk. Similarly, the first gear Gy and the second gear Gm engage with a common idler gear (a third gear) G2 and receive a drive force from the common idler gear G2.

Here, a force Fc which the first gear Gc receives from the idler gear G2 and a force Fk which the second gear Gk receives from the idler gear G2 act in respective different directions. Similarly, a force Fy which the first gear Gy receives from the idler gear G2 and a force Fm which the second gear Gm receives from the idler gear G2 act in respective different directions. This is one of the reasons why the first resultant force Fyc and the second resultant force Fmk act in respective different directions.

A second exemplary embodiment of the present invention is described with reference to FIG. 12.

Figure 12:
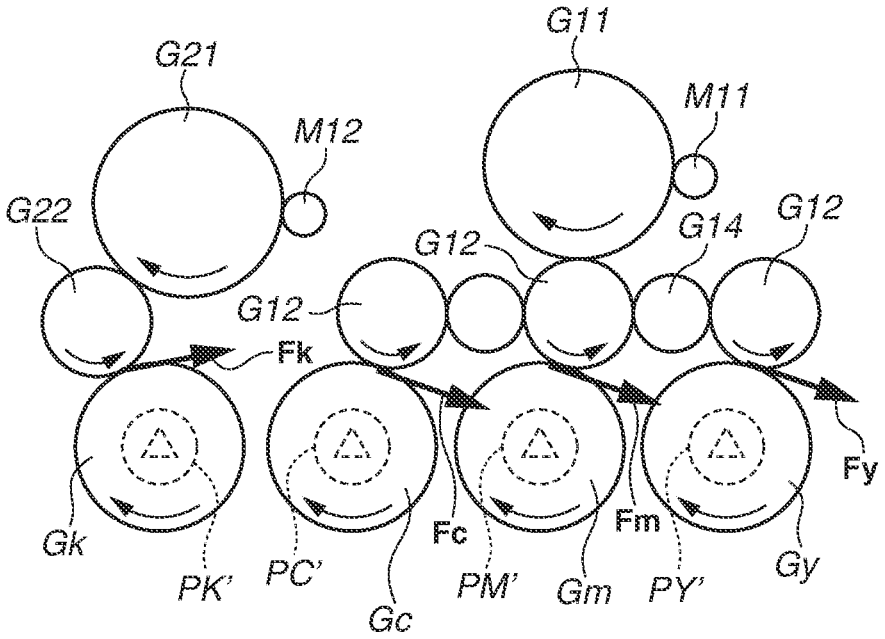
FIG. 12 is a schematic diagram of a drive portion in an image forming apparatus body according to a second exemplary embodiment of the present invention.

FIG. 12 illustrates an example of a gear train, which includes gears G11, G12, G14, G21, G22, Gy, Gm, Gc, and Gk, in the image forming apparatus body 2, in which two motors M11 and M12 are used.

In the configuration illustrated in FIG. 12, for example, one process cartridge PK' for black is driven by the motor M12, and the other process cartridges PY', PM', and PC' are driven by the motor M11.

In the case of the configuration illustrated in FIG. 12, also based on a similar idea to that in the first exemplary embodiment, flat surface portions (not illustrated) of the process cartridges are set according to the directions of resultant forces including intermeshing forces (not illustrated).

Thus, the inclinations of the flat surface portions (not illustrated) of the process cartridge PK' are made different from those of the flat surface portions (not illustrated) of the other process cartridges PY', PM', and PC'.

In the second exemplary embodiment, the process cartridges PY', PM', and PC' serve as a first image forming unit, and the cartridge PK' serves as a second image forming unit. The photosensitive drum 4 of each of the process cartridges PY', PM', and PC' serves as a first photosensitive drum 4, and the coupling member 4*a* thereof serves as a first drive input portion. The photosensitive drum 4 of the process cartridge PK' serves as a second photosensitive drum 4, and the coupling member 4*a* thereof serves as a second drive input portion.

Furthermore, even in a case where three motors are used, the flat surface portions can be configured based on a similar idea.

A third exemplary embodiment of the present invention is described with reference to FIGS. 13A, 13B, and 13C.

Figure 13A:
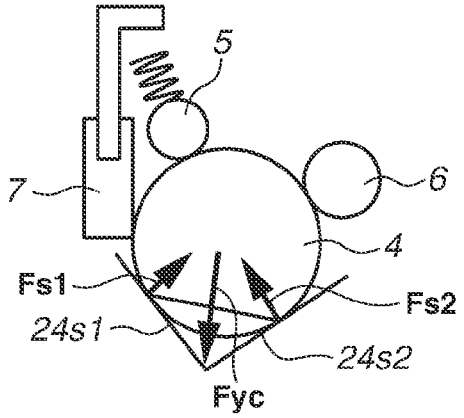
FIGS. 13A, 13B, and 13C are schematic diagrams illustrating the vicinity of a photosensitive drum portion according to a third exemplary embodiment of the present invention.
Figure 13B:
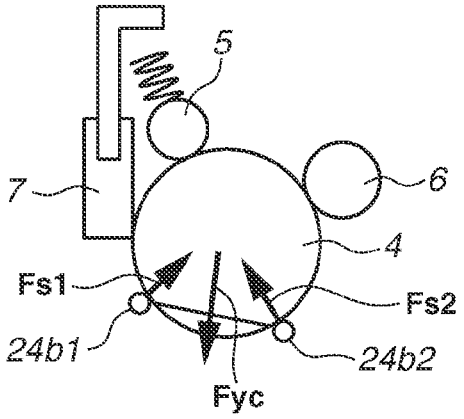

While, in the first exemplary embodiment, an example in which the shaft portion 4*a*1 of the photosensitive drum 4 is rotatably supported by flat surfaces as illustrated in FIG. 13A is described, the shaft portion 4*a*1 can be rotatably supported by inner cylindrical surfaces 24*b*1 and 24*b*2 as illustrated in FIG. 13B according to another exemplary embodiment.

Figure 13C:
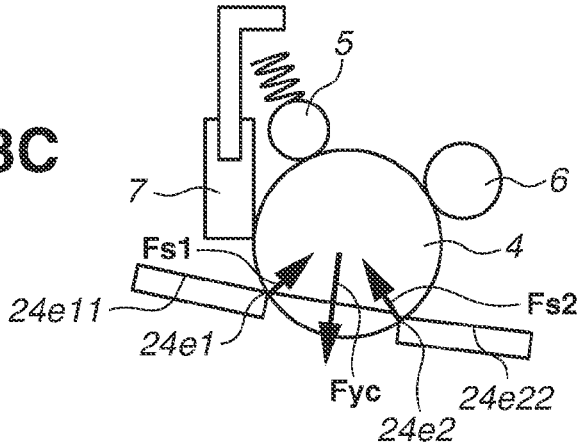

Furthermore, according to yet another exemplary embodiment, the shaft portion 4*a*1 can be rotatably supported by ridge lines 24*e*1 and 24*e*2 which are formed by a pair of plate-like members 24*e*11 and 24*e*22, as illustrated in FIG. 13C.

Also in each of these exemplary embodiments, adaptive and optimum supporting positions can be designed according to a resultant force of forces which the photosensitive drum of each process cartridge receives, so that reaction forces Fs1 and Fs2 can be made as equal as possible.

Moreover, while, in the above-described exemplary embodiments, an example in which a process cartridge that is detachably attachable to the image forming apparatus body is used has been described, the present invention can be applied to an example in which the photosensitive drum 4 is fixed to the image forming apparatus body.

As described above, since the angles of receiving surfaces for the photosensitive drum of a process cartridge are made different from those of another process cartridge, a force exerted on the receiving surfaces receiving each photosensitive drum is approximately equally distributed. As a result, the abrasion or the amount of deformation of the receiving surfaces can be reduced, so that the position of each photosensitive drum can be stabilized even after a long use.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-039420 filed Feb. 27, 2015, and No. 2016-009780, filed Jan. 21, 2016, which are hereby incorporated by reference herein in their entirety.

What is claimed is:

1. An image forming apparatus comprising:

a first photosensitive drum;

a second photosensitive drum;

a first drive input portion located at one end in a first axial direction of the first photosensitive drum;

a second drive input portion located at one end in a second axial direction of the second photosensitive drum;

a first supporting member including a first supporting portion and a second supporting portion that support a side of the one end in the first axial direction of the first photosensitive drum in such a way as to allow the first photosensitive drum to rotate; and a second supporting member including a third supporting portion and a fourth supporting portion that support a side of the one end in the second axial direction of the second photosensitive drum in such a way as to allow the second photosensitive drum to rotate, wherein, when a line connecting a midpoint of a line segment connecting the first supporting portion and the second supporting portion and a rotational center of the first photosensitive drum as viewed from the first axial direction is referred to as a first straight line, and a line connecting a midpoint of a line segment connecting the third supporting portion and the fourth supporting portion and a rotational center of the second photosensitive drum as viewed from the second axial direction is referred to as a second straight line, the first straight line as viewed from the first axial direction and the second straight line as viewed from the second axial direction are not parallel to each other.

2. The image forming apparatus according to claim 1, further comprising:

a first gear including a first drive output portion that engages with the first drive input portion to transmit a drive force to the first drive input portion, and configured to rotate integrally with the first photosensitive drum; and a second gear including a second drive output portion that engages with the second drive input portion to transmit a drive force to the second drive input portion, and configured to rotate integrally with the second photosensitive drum, wherein an intermeshing point at which the first gear meshes with a gear that transmits a drive force to the first gear as viewed from the first axial direction and an intermeshing point at which the second gear meshes with a gear that transmits a drive force to the second gear as viewed from the second axial direction are located at respective different rotational phases.

3. The image forming apparatus according to claim 2, wherein the gear that transmits a drive force to the first gear and the gear that transmits a drive force to the second gear are one and the same gear.

4. The image forming apparatus according to claim 2, further comprising a first contact member configured to contact a surface of the first photosensitive drum and a second contact member configured to contact a surface of the second photosensitive drum, wherein, when the first photosensitive drum is rotating, a vector of a resultant force of a force which the first photosensitive drum receives from the first contact member and a force which the first gear receives from the gear that meshes with the first gear is parallel to the first straight line, and wherein, when the second photosensitive drum is rotating, a vector of a resultant force of a force which the second photosensitive drum receives from the second contact member and a force which the second gear receives from the gear that meshes with the second gear is parallel to the second straight line.

5. The image forming apparatus according to claim 1, wherein the first drive input portion includes a first coupling, and the second drive input portion includes a second coupling.

6. The image forming apparatus according to claim 1, wherein a direction of a first resultant force which the first photosensitive drum receives is different from a direction of a second resultant force which the second photosensitive drum receives.

7. The image forming apparatus according to claim 6, wherein a direction in which the second straight line is inclined relative to the first straight line is the same as a direction in which the second resultant force is inclined relative to the first resultant force.

8. The image forming apparatus according to claim 1, wherein each of the first photosensitive drum and the second photosensitive drum includes a cylindrical portion, which is equipped with a photosensitive layer, and a shaft portion, which is smaller in diameter than the cylindrical portion, and wherein the first supporting member and the second supporting member support the shaft portions of the first photosensitive drum and the second photosensitive drum, respectively.

9. The image forming apparatus according to claim 1, wherein the first photosensitive drum, the first drive input portion, and the first supporting member are mounted in a first cartridge that is attachable to and detachable from an apparatus body of the image forming apparatus, and the second photosensitive drum, the second drive input portion, and the second supporting member are mounted in a second cartridge that is attachable to and detachable from the apparatus body.

10. The image forming apparatus according to claim 1, wherein the first photosensitive drum and the second photosensitive drum are configured to allow toner images of respective different colors to be formed thereon.

11. A cartridge group comprising:

a first cartridge including (i) a first photosensitive drum, (ii) a first drive input portion located at one end in a first axial direction of the first photosensitive drum, (iii) a first supporting member including a first supporting portion and a second supporting portion that support a side of the one end in the first axial direction of the first photosensitive drum in such a way as to allow the first photosensitive drum to rotate, and (iv) a first developing roller; and a second cartridge including (v) a second photosensitive drum, (vi) a second drive input portion located at one end in a second axial direction of the second photosensitive drum, (vii) a second supporting member including a third supporting portion and a fourth supporting portion that support a side of the one end in the second axial direction of the second photosensitive drum in such a way as to allow the second photosensitive drum to rotate, and (viii) a second developing roller, wherein, when an angle made by a straight line connecting a midpoint of a line segment connecting the first supporting portion and the second supporting portion and a rotational center of the first photosensitive drum with a straight line connecting the rotational center of the first photosensitive drum and a rotational center of the first developing roller as viewed from the first axial direction is referred to as a first angle, and an angle made by a straight line connecting a midpoint of a line segment connecting the third supporting portion and the fourth supporting portion and a rotational center of the second photosensitive drum with a straight line connecting the rotational center of the second photosensitive drum and a rotational center of the second developing roller as viewed from the second axial direction is referred to as a second angle, the first angle is different from the second angle.

12. The cartridge group according to claim 11, wherein each of the first photosensitive drum and the second photosensitive drum includes a cylindrical portion, which is equipped with a photosensitive layer, and a shaft portion, which is smaller in diameter than the cylindrical portion, and wherein the first supporting member and the second supporting member support the shaft portions of the first photosensitive drum and the second photosensitive drum, respectively.

13. The cartridge group according to claim 11, wherein the first photosensitive drum and the second photosensitive drum are configured to allow toner images of respective different colors to be formed thereon.

14. The cartridge group according to claim 11, wherein the first cartridge and the second cartridge are attachable to an image forming apparatus, wherein the image forming apparatus includes:

a first gear including a first drive output portion that engages with the first drive input portion to transmit a drive force to the first drive input portion, and configured to rotate integrally with the first photosensitive drum; and a second gear including a second drive output portion that engages with the second drive input portion to transmit a drive force to the second drive input portion, and configured to rotate integrally with the second photosensitive drum, and wherein an intermeshing point at which the first gear meshes with a gear that transmits a drive force to the first gear as viewed from the first axial direction and an intermeshing point at which the second gear meshes with a gear that transmits a drive force to the second gear as viewed from the second axial direction are located at respective different rotational phases.

15. The cartridge group according to claim 14, wherein the gear that transmits a drive force to the first gear and the gear that transmits a drive force to the second gear are one and the same gear.

16. The cartridge group according to claim 11, wherein the first drive input portion includes a first coupling, and the second drive input portion includes a second coupling.

17. The cartridge group according to claim 11, wherein an absolute value of a difference between the first angle and the second angle is 15° or more.

* * * * *